US008123374B2

(12) United States Patent
Beghelli

(10) Patent No.: US 8,123,374 B2
(45) Date of Patent: Feb. 28, 2012

(54) LIGHTING APPLIANCE WITH A REDUCED ENCUMBRANCE FOR INDUSTRIAL ENVIRONMENTS

(75) Inventor: Gian Pietro Beghelli, Monteveglio (IT)

(73) Assignee: Beghelli S.p.A., Monteveglio (Bologna) (IT)

( * ) Notice: Subject to any disclaimer, the term of this patent is extended or adjusted under 35 U.S.C. 154(b) by 0 days.

(21) Appl. No.: 11/415,753

(22) Filed: May 2, 2006

(65) Prior Publication Data

US 2006/0256566 A1 Nov. 16, 2006

(30) Foreign Application Priority Data

May 9, 2005 (IT) ..... VI2005A0140

(51) Int. Cl.
*F21S 8/00* (2006.01)

(52) U.S. Cl. ..... 362/147; 362/277; 362/322

(58) Field of Classification Search ..... 362/277, 362/147, 148, 280, 322
See application file for complete search history.

(56) References Cited

U.S. PATENT DOCUMENTS

| | | | | |
|---|---|---|---|---|
| 2,739,226 | A * | 3/1956 | Rex | 362/297 |
| 3,329,812 | A * | 7/1967 | Harling | 362/223 |
| 4,729,065 | A | 3/1988 | Bahnemann | |
| 5,121,309 | A | 6/1992 | Ewing | |
| 6,200,007 | B1 * | 3/2001 | Minissi et al. | 362/373 |
| 2003/0185012 | A1 * | 10/2003 | Sitzema et al. | 362/328 |

OTHER PUBLICATIONS

European Search Report, Mar. 9, 2007.

* cited by examiner

*Primary Examiner* — Diane Lee
*Assistant Examiner* — Sean Gramling
(74) *Attorney, Agent, or Firm* — Hedman & Costigan, P.C.; James V. Costigan

(57) ABSTRACT

A lighting appliance with a reduced encumbrance for industrial environments, comprising a head (11), equipped with an upper support (10) for hooking the appliance to the ceiling of an industrial warehouse or building in general, and two reflectors which can be disassembled from the appliance structure, one (13) above or inside the head (11), with a complex faceted optical system, and one (12) lower or outside the head (11), with a segmented geometry; a vertical regulation system of the lamp (15) of the lighting appliance allows the illuminating engineering characteristics of the appliance to be varied, obtaining different photometric conditions according to the distance of the lamp (15) from the work surface.

4 Claims, 6 Drawing Sheets

LIGHTING APPLIANCE WITH A REDUCED ENCUMBRANCE FOR INDUSTRIAL ENVIRONMENTS

The present invention relates to a lighting appliance with a reduced encumbrance for industrial environments.

Lamps or appliances for direct lighting are widely used for the artificial illumination of buildings for civil and industrial use, both as a main light source and as an emergency or safety source; in particular, lighting appliances for industrial environments generally comprise a bell-shaped reflector, which houses a lamp, connected to terminals which allow the electric charge.

A particularly strongly-felt problem, especially on the part of wholesalers of electric material, relating to lighting appliances of the traditional type, concerns the overall encumbrance of the supporting structures of light sources.

The construction of lighting appliances of the known type do not in fact allow an effective reduction in the encumbrance, particularly with respect to the transportation and storage of the packagings.

An objective of the present invention is therefore to eliminate the reported drawbacks by providing a lighting appliance with a reduced encumbrance for industrial environments, which allows the saving of storage space.

A further objective of the present invention is to provide a lighting appliance with a reduced encumbrance for industrial environments, which allows a substantial reduction in warehouses, materials referring to raw materials and packaging, as well as in transport and storage costs.

Another objective of the invention is to provide a lighting appliance with a reduced encumbrance for industrial environments, which allows good performances to be obtained, as a result of optimized production processes.

A last objective of the invention is to provide a lighting appliance with a reduced encumbrance for industrial environments, which has an excellent quality/price ratio and which can be easily installed and maintained.

These and other objectives, according to the present invention, are achieved by providing a lighting appliance with a reduced encumbrance for industrial environments, according to the enclosed claim 1.

The characteristics and advantages of a lighting appliance with a reduced encumbrance for industrial environments, according to the invention, will appear more evident from the following illustrative and non-limiting description, referring to a preferred embodiment, and to the enclosed drawings, in which.

Figure 5C:
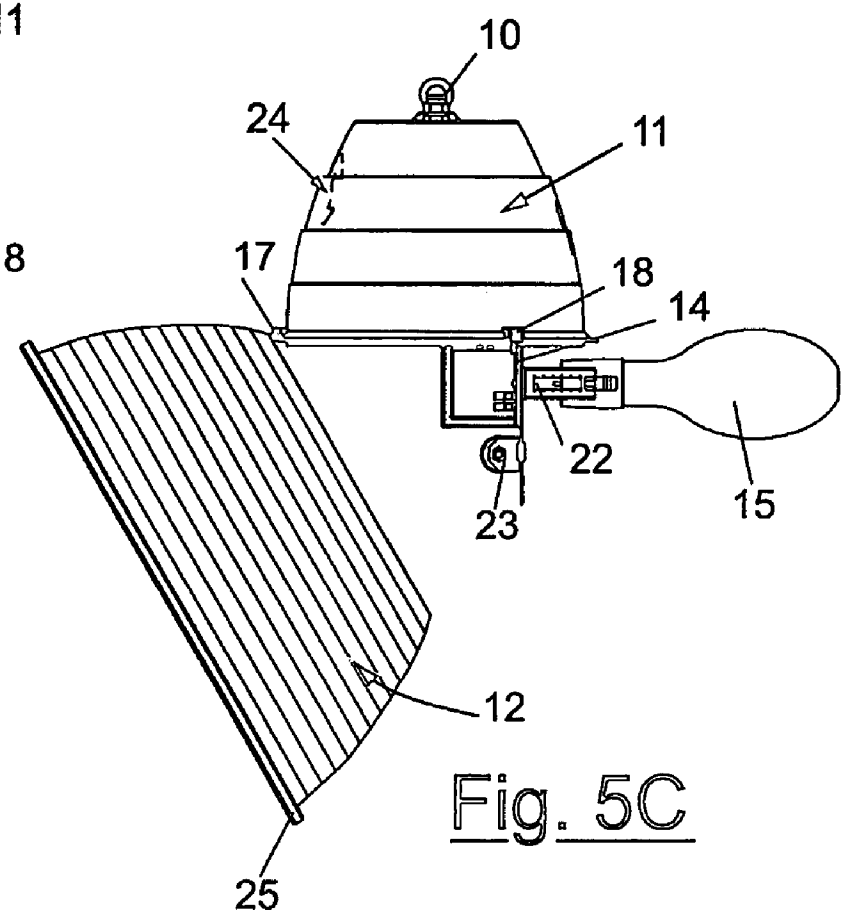
Figure 5B:
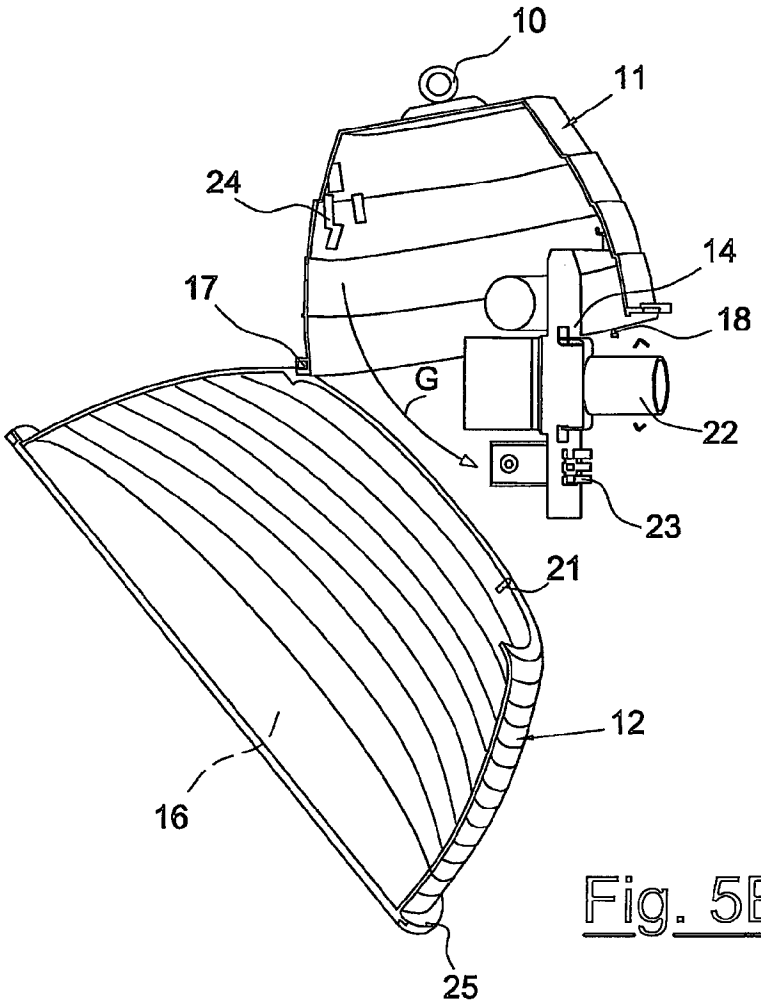
Figure 5A:
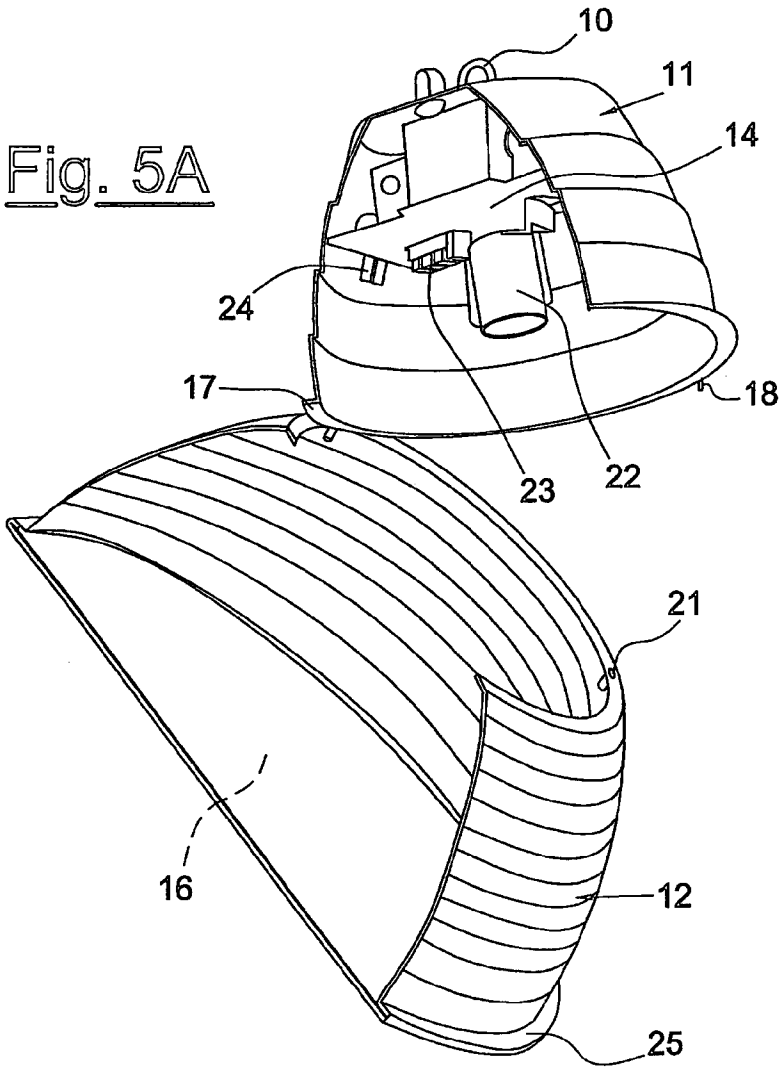
Figure 6B:
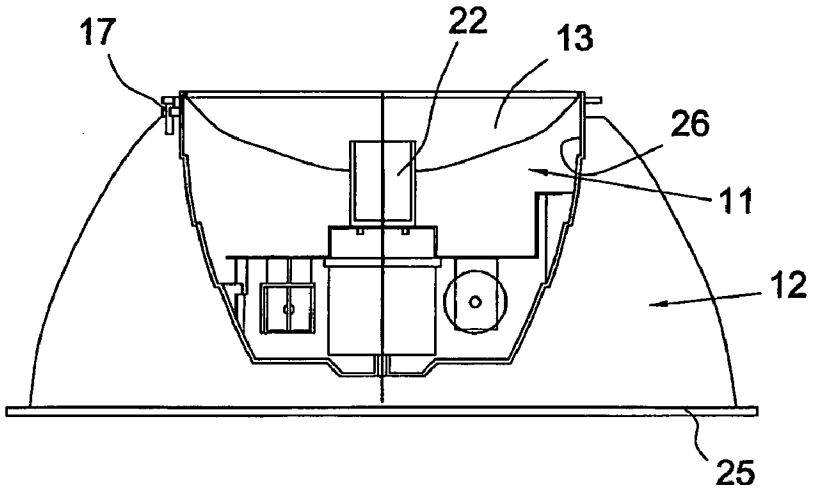
Figure 6A:
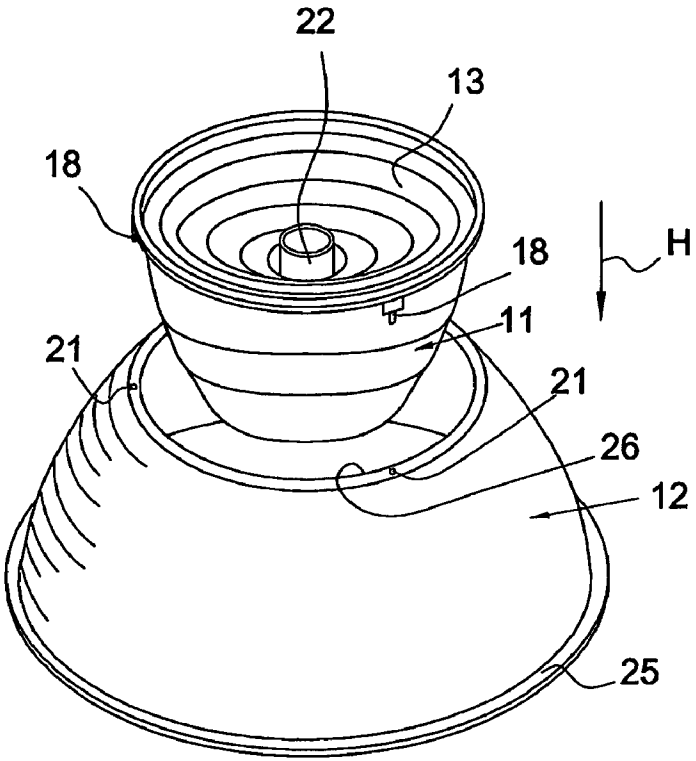
Figure 7:
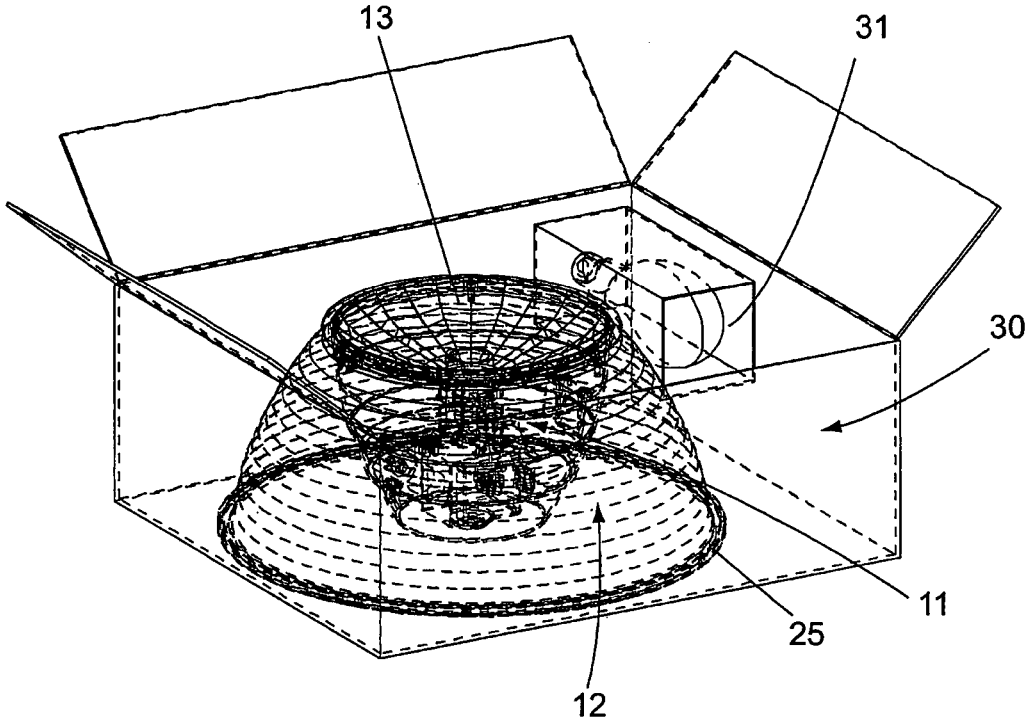

FIGS. 5A, 5B and 5C refer to respective side views of the lighting appliance for industrial environments, according to the invention, in an open position for a rapid maintenance of the electric connections;

FIGS. 6A and 6B show partial, exploded and sectional, side views, of a lighting appliance for industrial environments, suitable for being packaged for transportation and storage, according to the present invention;

FIG. 7 is a perspective view of the lighting appliance for industrial environments, according to the present invention, housed in a packaging container.

Figure 1:
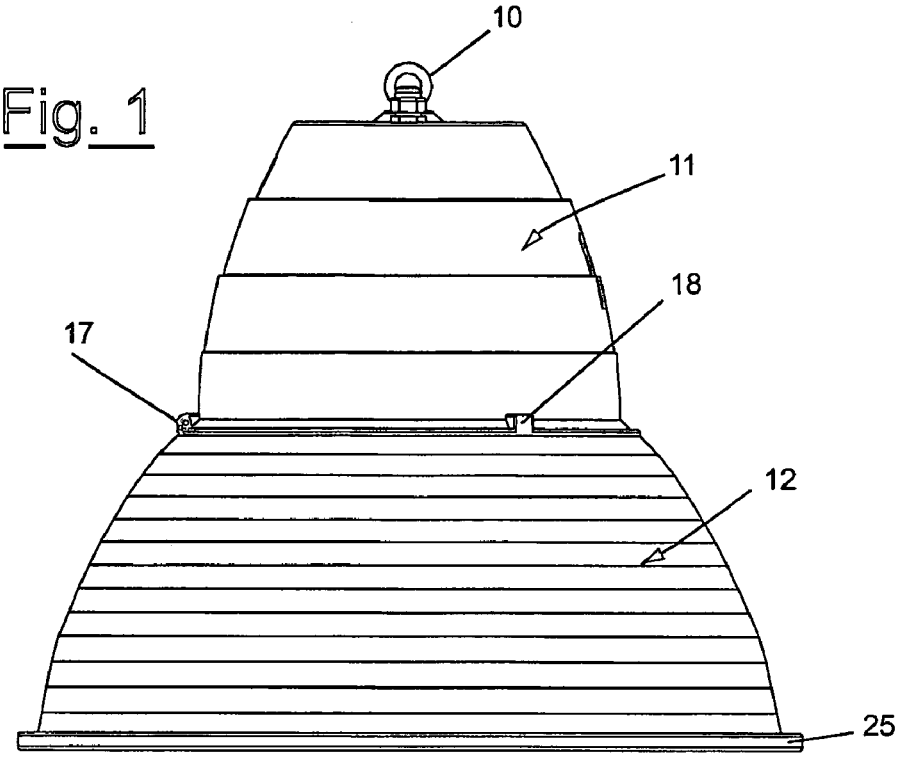
FIG. 1 is a side view of the lighting appliance with a reduced encumbrance for industrial environments, according to the present invention.
Figure 2:
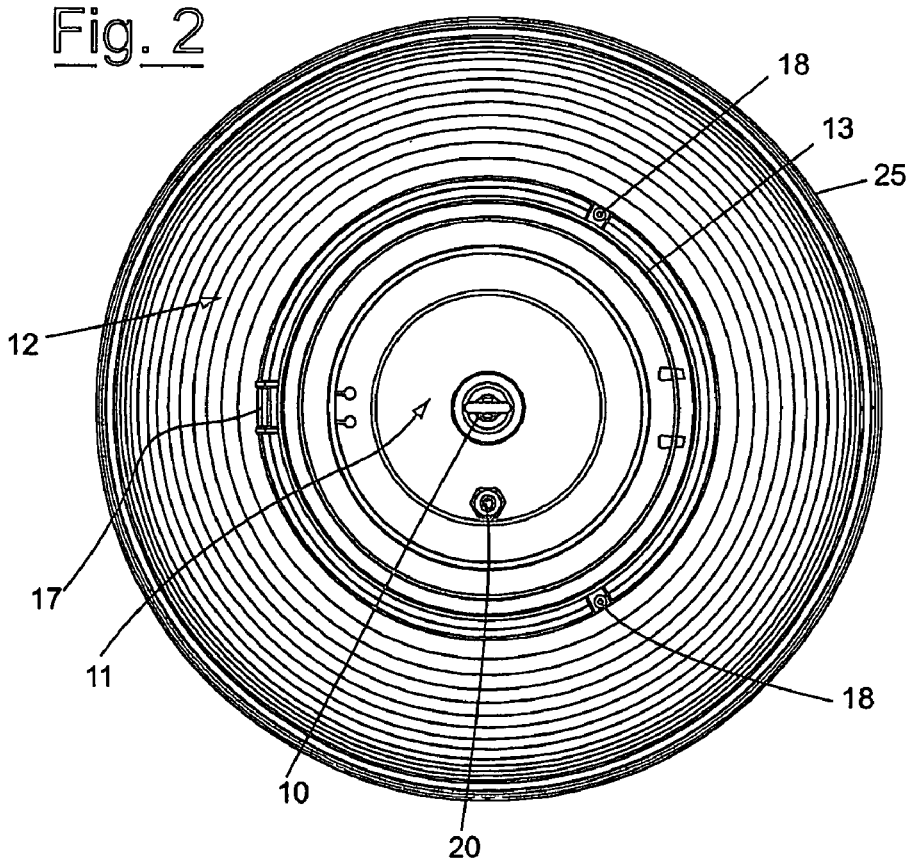
FIG. 2 is a plan view from above of the lighting appliance for industrial environments, according to the present invention.

With particular reference to FIGS. 1 and 2 mentioned above, the lighting appliance for industrial environments, according to the present invention, essentially consists of an upper support 10 for hooking the appliance to the ceiling of an industrial warehouse or building in general, a head 11 and two reflectors, one above or inside the head 11, generically indicated with 13, and a lower or external reflector, indicated with 12, which have substantially different functions and optical properties.

In particular, the reflector 13 inside the head 11 is produced as a moulded product, with a complex faceted optical system, and guarantees the quantity of light necessary on the vertical axis of the lighting appliance, avoiding interference with the light source situated internally and ensuring a high performance.

The outer or lower reflector 12, on the other hand, shaped with a cylindrical symmetry and possibly made of transparent methacrylate, has a segmented geometry so as to illuminate the working surface in areas far from the vertical axis of the lighting appliance; for this purpose, it is possible to increase the distance between subsequent appliances thus reducing, with respect to the traditional solutions, the number of lighting appliances necessary for obtaining suitable lighting conditions on a certain working surface.

Figure 3:
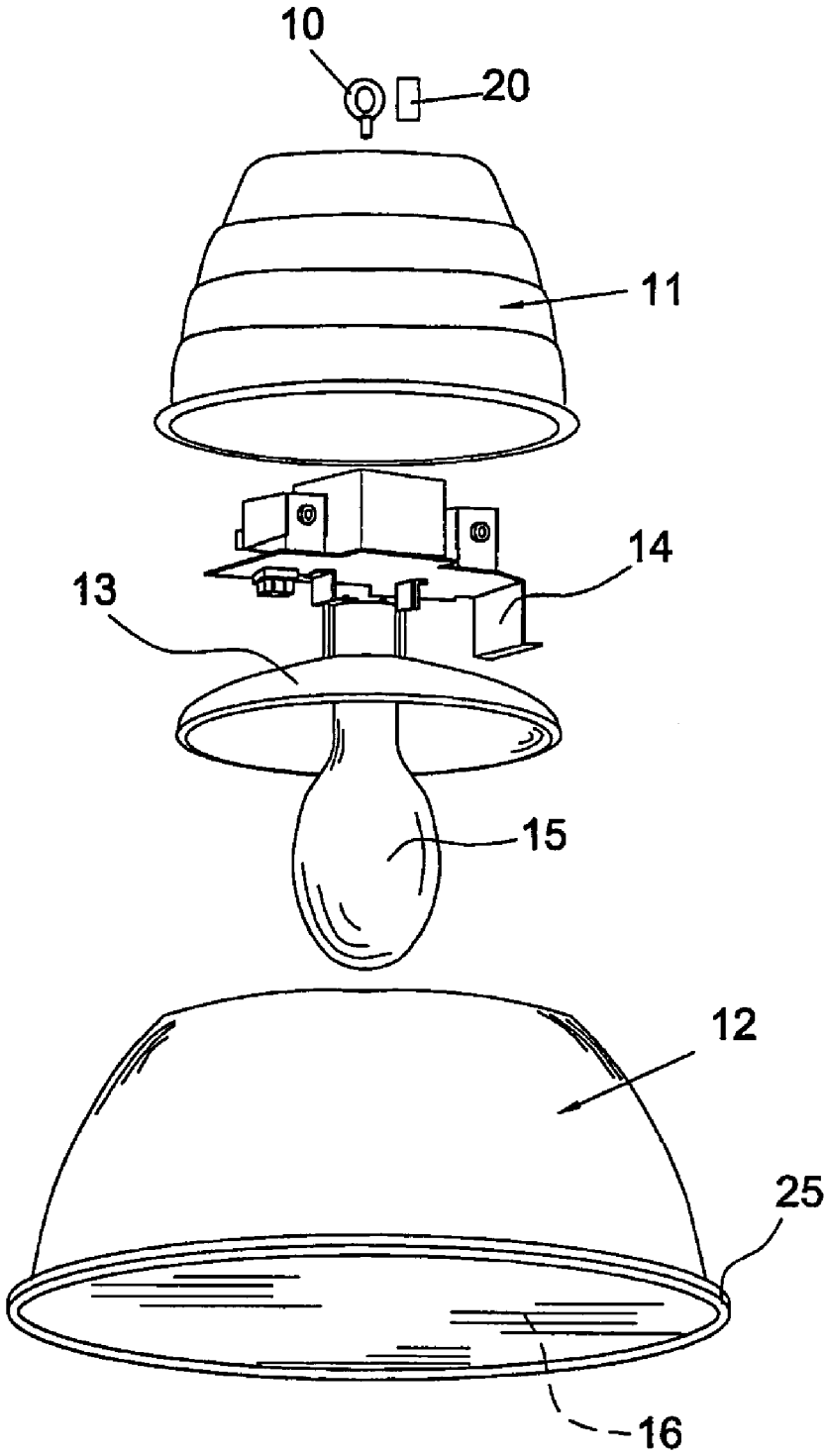
FIG. 3 is an exploded view of the lighting appliance for industrial environments, according to the present invention.

FIG. 3 shows in detail the main components of the lighting appliance for industrial environments, according to the invention.

In particular, it is possible to identify the hooking support 10, a wirelead element 20 for the inlet of the feeding wires, the head 11, in which a plate 14 is positioned where the electric and/or electronic components of the lighting appliance, the upper reflector 13 and the lower reflector 12, inside which there is a lamp 15, are fixed.

On the bottom of the lower reflector 12, there can also be a circular transparent glass 16, crimped on the edge 25 of the reflector 12, which covers the whole base of the above lower reflector 12 and contributes to optimizing the illuminating engineering characteristics of the appliance according to the invention.

The appliance can be used according to standards IP65 and IP40, in the versions with 250 and 400 Watt lamps 15, with metal iodides, high pressure sodium or with mercury vapours.

Figure 4:
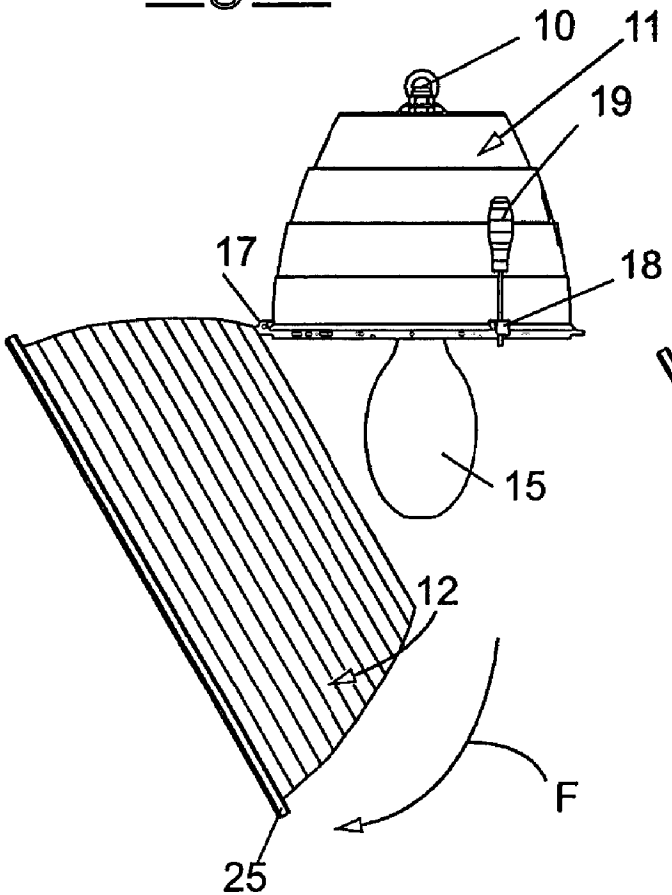
FIG. 4 is a side view of the lighting appliance for industrial environments, according to the invention, in an open position for the substitution of the lamp.

As illustrated in detail in FIG. 4, the external reflector 12 is connected to the head 11 by means of a hinge 17 and respective fixing screws 18 inserted in respective threaded housings 21, so that, by acting on the screws 18 with a screwdriver 19 to free them from the housings 21, it is possible to rotate the reflector 12 according to the direction of the arrow F for an easy substitution of the lamp 15.

In FIGS. 5A and 5B, which illustrate the lighting appliance without the internal reflector 13 and lamp 15, and also FIG. 5C, a further unhooking procedure is shown, of the components of the lighting appliance, according to the invention, for its rapid installation.

In particular, it can be observed that the plate 14, where the electric and/or electronic components of the lighting appliance are fixed, among which the lamp holder 22 and the terminal board 23 for the electric connections of the appliance to the power supply, is hooked, by means of a spring 24, in a horizontal position, inside and in correspondence with the top of the head 11 of the lighting appliance (FIG. 5A).

It is therefore sufficient to act on the spring hook 24, in order to unhook the plate 14 from inside the head 11 and rotate it according to the direction of the arrow G of FIG. 5B, so as to have free and facilitated access to the terminal board 23 and to the lamp holder 22 for the necessary wiring and further maintenance operations.

FIG. 5C schematically represents the same view as FIG. 5B with the lamp 15 inserted.

One of the specific advantages of the dissembling of the lighting apparatus into two reflectors, an outer reflector 12 and an inner reflector 13, lies in the fact that, in this way, it is possible, after removing the lamp 15 and the hinge 17, in order to be able to unhook the head 11 from the outer reflector 12, to house the head 11, overturned and complete with inner reflector 13, in the upper space 26 of the outer reflector 12 (according to the direction of the arrow H of FIG. 6A).

An extremely compact structure is therefore obtained (FIG. 6B), with a considerably reduced encumbrance for the transportation and storage of the lighting appliance, according to the invention.

FIG. 7 illustrates a particular type of packaging, generically indicated with 30, with an extremely reduced encumbrance, containing the structure of the lighting appliance, dismantled and positioned as described above with reference to FIGS. 6A and 6B.

The packaging 30, also complete with a possible insert 31 for containing the lamp 15 and other accessories of the lighting appliance, has considerably limited encumbrance dimensions, with respect to traditional solutions of containers suitable for containing analogous types of lighting appliances for industrial environments.

From what is specified above, it is evident that the innovative design of the two-reflector structure of the lighting appliance according to the present invention, allows its overall encumbrance to be considerably minimized during the transportation and storage of the pieces; the reduced encumbrance of the appliance also saves storage space thus allowing a greater number of packagings (stackable) on top of a pallet and/or inside a container having a predefined volume, to be contained.

It is therefore verified how the particular design of the lighting appliance leads to reduced dimensions, with respect to the traditional appliances, of the packaged product; a considerable simplification in the assembly and wiring of the appliance is also obtained, with respect to traditional solutions having the same functionality.

Furthermore, a vertical regulation system of the lamp 15, although leaving the two reflectors 12 and 13 unvaried, drastically changes the illuminating engineering characteristics of the appliance, as if there were two different appliances.

The options relating to the optical system of the outer reflector 12 and the inner reflector 13 allow different photometric conditions to be obtained by varying the distance of the lamp 15 from the working surface.

For example, the following table illustrates the performances of the lighting appliance according to the invention by varying the position of the lamp 15 (in this respect, an original starting configuration is conventionally called position 0 and the further positions of the lamp are taken at +10/+20/+30 mm. and at −10/−20 mm., respectively).

| Position of lamp | Performance | Vertical axis intensity | Installation height |
|---|---|---|---|
| +30 | 80.28% | 14835 cd | 7 m. |
| +20 | 80.46% | 12437 cd | 6.4 m. |
| +10 | 80.29% | 10039 cd | 5.8 m. |
| 0 | 79.83% | 7705 cd | 5 m. |

-continued

| Position of lamp | Performance | Vertical axis intensity | Installation height |
|---|---|---|---|
| −10 | 79.11% | 5787 cd | 4.4 m. |
| −20 | 78.05% | 4092 cd | 3.7 m. |

It can be observed that the performance of the appliance is high in all conditions with respect to the original configuration (0) and actually improves with respect to the original design in positions +10/+20/+30 m.; it should also be noted that the value of the installation height has been calculated for the single lighting appliance and that consequently, in a real plant, consisting of various appliances, this value is definitely higher.

The technical characteristics of the lighting appliance with a reduced encumbrance, for industrial environments, according to the present invention, appear evident from the above description, as also the advantages.

In particular, among these, the following can be mentioned:

reduction in the encumbrance;
reduction in the warehouses;
reduction in the materials (raw materials and packagings);
reduction in the transportation and storage costs;
innovative design;
performances equal to market references;
easy installation and maintenance;
excellent quality/price ratio;
optimization in the production processes.

Finally, numerous other variants can obviously be applied to the lighting appliance in question, all included in the novelty principles inherent in the inventive idea. In the practical embodiment of the invention, the materials, forms and dimensions of the details illustrated can also obviously vary according to the demands and can be substituted with other technically equivalent alternatives.

The invention claimed is:

1. A lighting appliance with a reduced encumbrance for industrial environments, consisting of: a head (11), equipped with an upper support (10) for hooking the lighting appliance to the ceiling of an industrial warehouse or building in general, and first reflector (13) positioned in a first light reflecting direction and a second moveable reflector (12), having a circular transparent glass (16) and a crimped edge (25), said second moveable reflector being positioned to reflect light in a second light reflecting direction parallel to said first light reflecting direction whereby said second moveable reflector (12) can be at least partially rotated with respect to said first reflector (13) and head (11), said second reflector being connected to the head (11) and inside which there is at least one lamp or light source (15) mounted on a lamp holder (22) that is affixed to a plate (14) said plate (14) having fixed thereto a terminal board (23) for electric connections, said plate (14) being hooked by spring (24) to head (11), characterized in that said reflectors, which can be dissembled from each other and from the head (11) of the appliance, of which said first reflector (13) is situated inside said head (11) and said second reflector (12) is positioned below and outside said head (11) said second moveable reflector (12) being connected to the head (11) by means of at least one hinge (17) and respective removable fixing elements (18), so that said second moveable reflector (12) can be at least partially rotated on said at least one hinge (17) said hinge (17) being placed on the upper opening of said second reflector (12), said rotation being, with respect to the head (11) and said first reflector (13), according to a pre-established direction (F), for easy substitution of the lamp (15), said head (11) being removable from said second moveable reflector (12) so that said head (11) may be separated from said second moveable reflector and being adapted to be housed, together with said first reflector (13), within the upper space (26) of said second reflector (12) when said head (11) and said first reflector (13) are overturned from said second light reflecting direction of said second reflector (12) in order to provide an extremely compact packaging structure for the transportation and storage of the lighting appliance.

2. The lighting appliance according to claim 1, characterized in that said first reflector (13) has a complex faceted optical system, and guarantees a certain quantity of light on a vertical axis of the lighting appliance, preventing interference with the lamp or light source (15).

3. The lighting appliance according to claim 1, characterized in that said second reflector (12) has a cylindrical symmetry and a segmented geometry, so as to illuminate a working surface in areas far from the vertical axis of the lighting appliance.

4. The lighting appliance according to claim 1, characterized in that lamp holder (22) of said lamp or light source (15) allows the illuminating engineering characteristics of the appliance to be varied, obtaining different photometric conditions according to the distance of said lamp or light source (15) from a work surface.

* * * * *